US011387036B2

(12) United States Patent
Yen et al.

(10) Patent No.: US 11,387,036 B2
(45) Date of Patent: Jul. 12, 2022

(54) INDUCTOR DEVICE

(71) Applicant: Realtek Semiconductor Corporation, Hsinchu (TW)

(72) Inventors: Hsiao-Tsung Yen, Hsinchu (TW); Ka-Un Chan, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 343 days.

(21) Appl. No.: 16/823,557

(22) Filed: Mar. 19, 2020

(65) Prior Publication Data

US 2020/0312521 A1 Oct. 1, 2020

Related U.S. Application Data

(60) Provisional application No. 62/826,286, filed on Mar. 29, 2019, provisional application No. 62/871,263, filed on Jul. 8, 2019.

(30) Foreign Application Priority Data

Dec. 10, 2019 (TW) ..... 108145177

(51) Int. Cl.
*H01F 27/28* (2006.01)
*H01F 27/29* (2006.01)
*H01F 17/00* (2006.01)

(52) U.S. Cl.
CPC ..... *H01F 27/2804* (2013.01); *H01F 17/0013* (2013.01); *H01F 27/2828* (2013.01);
(Continued)

(58) Field of Classification Search
CPC ..... H01F 27/2804; H01F 17/0013; H01F 27/2828; H01F 27/29
See application file for complete search history.

(56) References Cited

U.S. PATENT DOCUMENTS 5,420,558 A 5/1995 Ito et al.
9,312,060 B2 4/2016 Godoy et al.
(Continued)

FOREIGN PATENT DOCUMENTS

CN 104769687 A 7/2015
CN 108022913 A 5/2018
(Continued)

OTHER PUBLICATIONS

China Patent Office, Office Action of the corresponding Chinese application No. 202010171503.0 dated Mar. 30, 2021.
(Continued)

*Primary Examiner* — Adolf D Berhane
*Assistant Examiner* — Afework S Demisse
(74) *Attorney, Agent, or Firm* — Locke Lord LLP; Tim Tingkang Xia, Esq.

(57) ABSTRACT

An inductor device includes a first wire, a second wire, a third wire, a fourth wire, and an eight-shaped inductor structure. The first wire includes at least two first sub-wires. The second wire includes at least two second sub-wires. The third wire includes at least two third sub-wires. The fourth wire includes at least two fourth sub-wires. The first wire is disposed in a first area. The second wire is disposed in a second area. The third wire is disposed in the first area and at least partially overlapped with the first wire in a vertical direction. The fourth wire is disposed in the second area and at least partially overlapped with the second wire in the vertical direction. The eight-shaped inductor structure is disposed on an outer side of the third wire and the fourth wire.

20 Claims, 4 Drawing Sheets

(52) U.S. Cl.
CPC ..... *H01F 27/29* (2013.01); *H01F 2017/004* (2013.01); *H01F 2017/0073* (2013.01); *H01F 2027/2809* (2013.01); *H01F 2027/2819* (2013.01)

(56) References Cited

U.S. PATENT DOCUMENTS

| | | | | |
|---|---|---|---|---|
| 10,186,364 | B2 | 1/2019 | Yen et al. | |
| 10,374,571 | B2 | 8/2019 | Wang et al. | |
| 2017/0098500 | A1* | 4/2017 | Yen | H01F 27/29 |
| 2018/0330872 | A1* | 11/2018 | Yen | H01F 27/34 |
| 2019/0148479 | A1* | 5/2019 | Yen | H01L 23/5227 336/173 |
| 2019/0221350 | A1 | 7/2019 | Yen et al. | |
| 2019/0279809 | A1 | 9/2019 | Yen | |
| 2019/0392980 | A1 | 12/2019 | Yen | |
| 2020/0234864 | A1 | 7/2020 | Elzinga | |

FOREIGN PATENT DOCUMENTS

| | | | |
|---|---|---|---|
| CN | 108962563 | A | 12/2018 |
| JP | 2010154517 | A | 7/2010 |
| TW | 201428783 | A | 7/2014 |
| TW | 201703070 | A | 1/2017 |
| TW | I591800 | B | 7/2017 |
| TW | I643216 | B | 12/2018 |
| TW | I643217 | B | 12/2018 |

OTHER PUBLICATIONS

Taiwan Patent Application 108141274 filed Nov. 13, 2019.
China Patent Office, Office Action of the corresponding Chinese application No. 201911129792.1 dated Mar. 29, 2021.
China Patent Office, Office Action of the related Chinese application No. 202010099915.8 dated Mar. 31, 2021.
China Patent Office, Office Action of the related Chinese application No. 202010099595.6 dated Mar. 29, 2021.
China Patent Office, Office Action of the related Chinese application No. 202010099604.1 dated Mar. 29, 2021.

* cited by examiner

INDUCTOR DEVICE

RELATED APPLICATIONS

This application claims priority to and the benefit of U.S. Provisional Patent Application No. 62/826,286, filed on Mar. 29, 2019, U.S. Provisional Patent Application No. 62/871,263, filed on Jul. 8, 2019, and Taiwan Application Serial Number 108145177, filed on Dec. 10, 2019, the entire contents of which are incorporated herein by reference as if fully set forth below in its entirety and for all applicable purposes.

BACKGROUND

Field of Invention

The present disclosure relates to an electronic device. More particularly, the present disclosure relates to an inductor device.

Description of Related Art

The various types of inductors according to the prior art have their advantages and disadvantages. For example, a spiral inductor has a higher Q value and a larger mutual inductance. However, its mutual inductance value and coupling are both occurred between the coils. For an eight-shaped inductor which has two sets of coils, the coupling between the two sets of coils is relatively low. However, an eight-shaped inductor occupies a larger area in a device. In addition, although a traditional stacked eight-shaped inductor has better symmetry, its inductance value per unit area is lower. Therefore, the scopes of application of the above inductors are limited.

For the foregoing reasons, there is a need to solve the above-mentioned problems by providing an inductor device.

SUMMARY

The foregoing presents a simplified summary of the disclosure in order to provide a basic understanding to the reader. This summary is not an extensive overview of the disclosure and it does not identify key/critical elements of the present disclosure or delineate the scope of the present disclosure. Its sole purpose is to present some concepts disclosed herein in a simplified form as a prelude to the more detailed description that is presented later.

One objective of the present disclosure is to provide an inductor device to resolve the problems of the prior art. The means of solution are described as follows.

One aspect of the present disclosure is to provide an inductor device. The inductor device includes a first wire, a second wire, a third wire, a fourth wire, and an eight-shaped inductor structure. The first wire includes at least two first sub-wires. The second wire includes at least two second sub-wires. The third wire includes at least two third sub-wires. The fourth wire includes at least two fourth sub-wires. The first wire is disposed in a first area. The second wire disposed in a second area. The third wire is disposed in the first area and at least partially overlapped with the first wire in a vertical direction. The fourth wire is disposed in the second area and at least partially overlapped with the second wire in the vertical direction. The eight-shaped inductor structure is disposed on an outer side of the third wire and the fourth wire.

Therefore, based on the technical content of the present disclosure, the inductor device according to the embodiment of the present disclosure has better symmetry in structure.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

According to the usual mode of operation, various features and elements in the figures have not been drawn to scale, which are drawn to the best way to present specific features and elements related to the disclosure. In addition, among the different figures, the same or similar element symbols refer to similar elements/components.

DESCRIPTION OF THE EMBODIMENTS

To make the contents of the present disclosure more thorough and complete, the following illustrative description is given with regard to the implementation aspects and embodiments of the present disclosure, which is not intended to limit the scope of the present disclosure. The features of the embodiments and the steps of the method and their sequences that constitute and implement the embodiments are described. However, other embodiments may be used to achieve the same or equivalent functions and step sequences.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include the singular. Specifically, as used herein and in the claims, the singular forms "a" and "an" include the plural reference unless the context clearly indicates otherwise.

Figure 1:
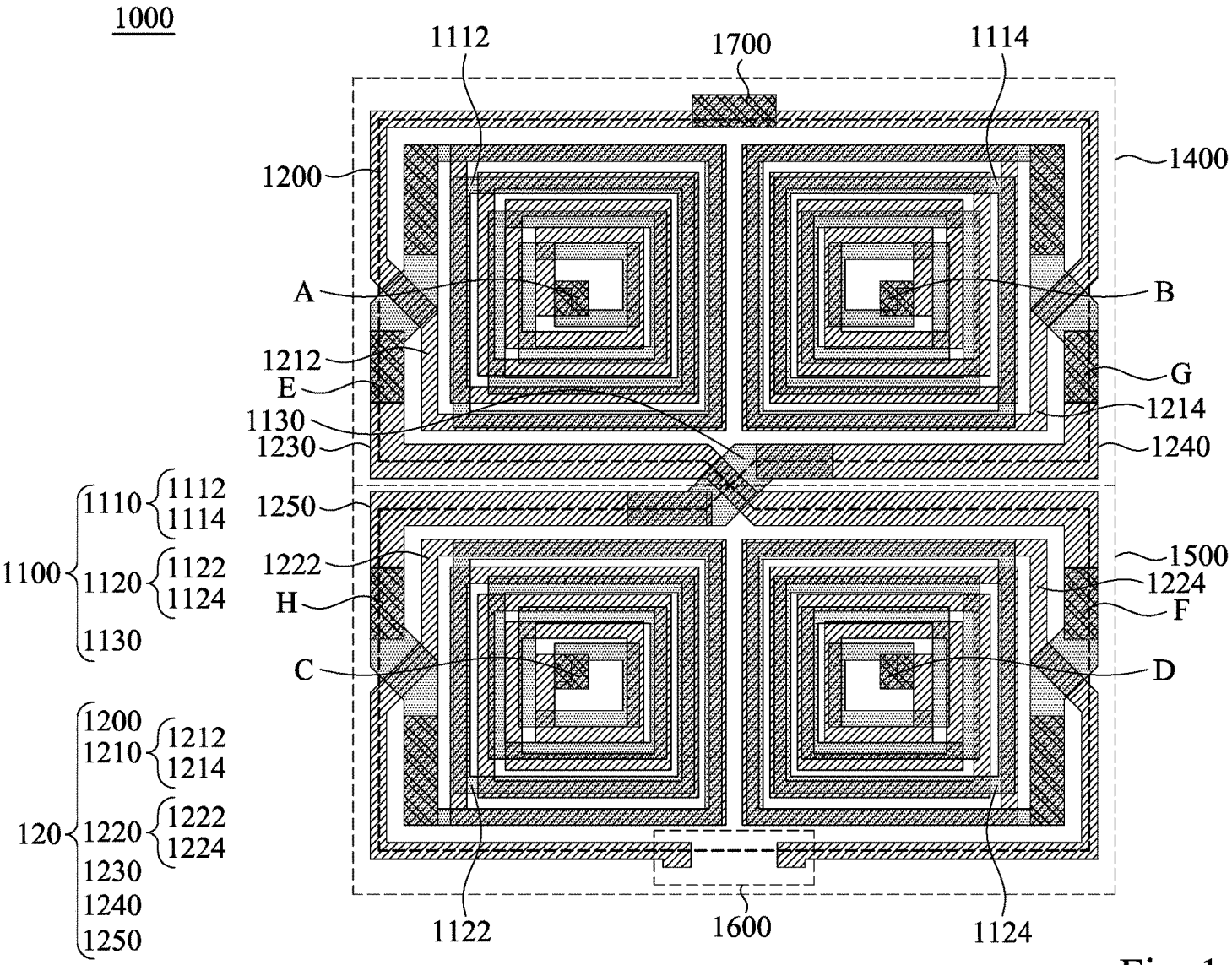
FIG. 1 depicts a schematic diagram of an inductor device according to one embodiment of the present disclosure.

FIG. 1 depicts a schematic diagram of an inductor device 1000 according to one embodiment of the present disclosure. The inductor device 1000 includes a first wire 1110, a second wire 1120, a third wire 1210, a fourth wire 1220, and an eight-shaped inductor structure 1200. The eight-shaped inductor structure 1200 is an outermost inductor wire (a wire portion shown by a dotted line) of the inductor device 1000. That is to say, the eight-shaped inductor structure 1200 is disposed on an outer side of the third wire 1210 and the fourth wire 1220. The first wire 1110 and the second wire 1120 are partially overlapped with the third wire 1210 and the fourth wire 1220, and the first wire 1110 and the second wire 1120 are disposed inside the eight-shaped inductor structure 1200.

Figure 2:
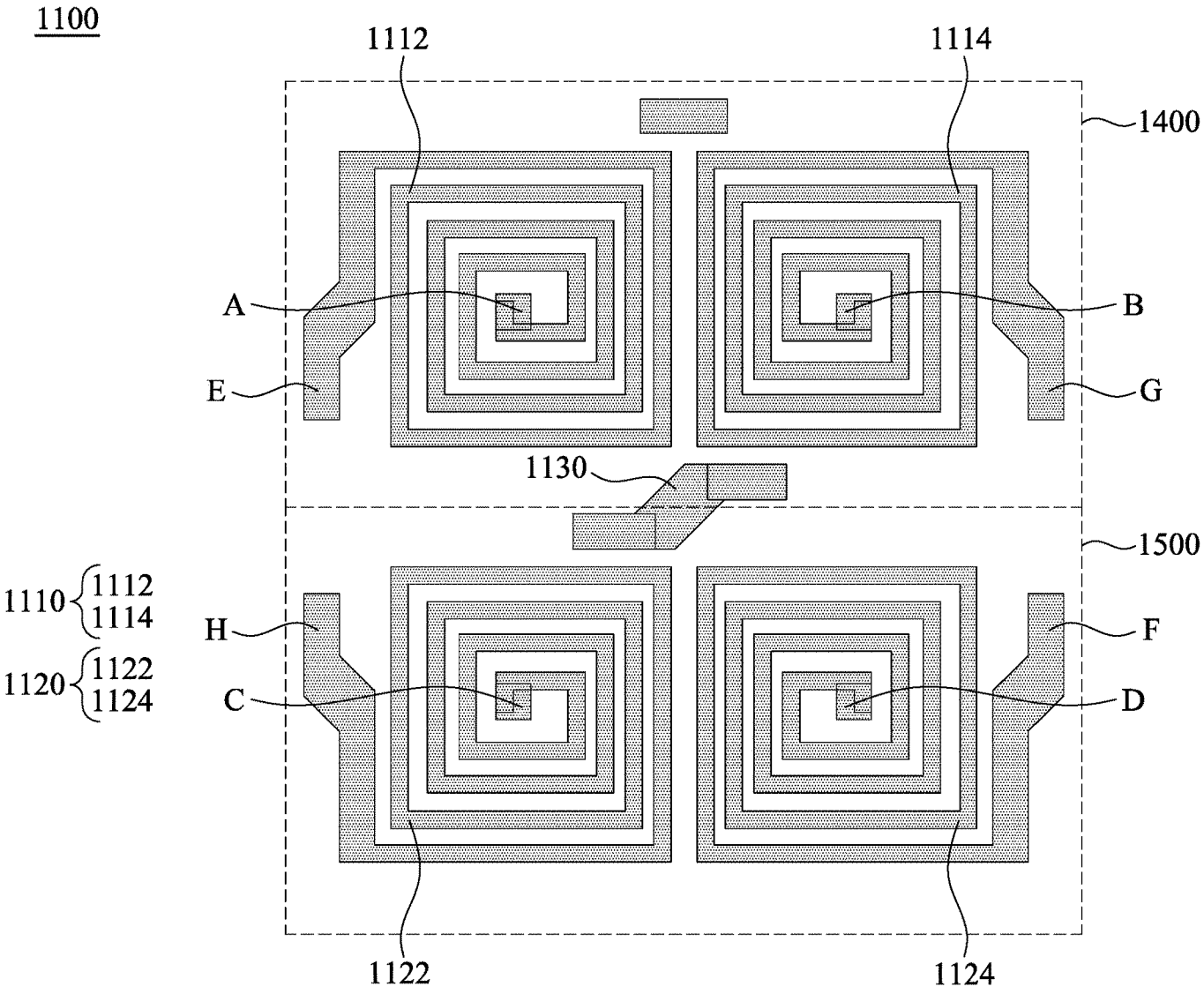
FIG. 2 depicts a schematic diagram of a partial structure of the inductor device shown in FIG. 1 according to one embodiment of the present disclosure.
Figure 3:
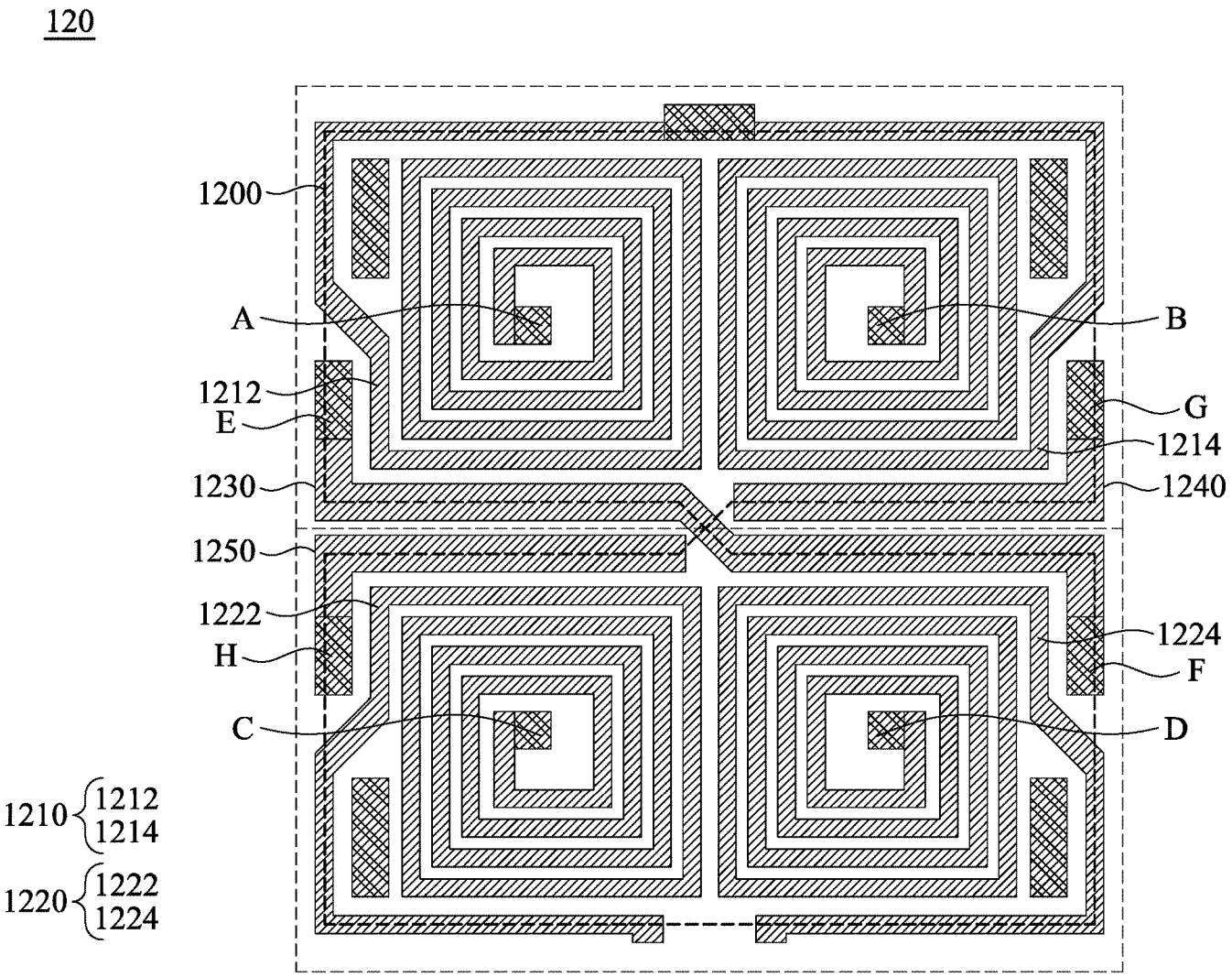
FIG. 3 depicts a schematic diagram of a partial structure of the inductor device shown in FIG. 1 according to one embodiment of the present disclosure.

To facilitate understanding of the present disclosure, the inductor device 1000 shown in FIG. 1 is divided into a partial structure 1100 of the inductor device 1000 shown in FIG. 2 and a partial structure 120 of the inductor device 1000 shown in FIG. 3. The partial structure 120 includes the eight-shaped inductor structure 1200, the third wire 1210, and the fourth wire 1220. A description is provided with reference to FIG. 1 to FIG. 3. The first wire 1110 includes at least two first sub-wires 1112, 1114. The second wire 1120 includes at least two second sub-wires 1122, 1124. The third wire 1210 includes at least two third sub-wires 1212, 1214. The fourth wire 1220 includes at least two fourth sub-wires 1222, 1224. The first wire 1110 is disposed in a first area 1400. The second wire 1120 is disposed in a second area 1500. For example, the first area 1400 is located on an upper side of the inductor device 1000, and the second area 1500 is located on a lower side of the inductor device 1000. A detailed structure and connection relationships are provided one by one as follows.

A description is provided with reference to FIG. 1 to FIG. 3. The third wire 1210 is disposed in the first area 1400 and at least partially overlapped with the first wire 1110 in a vertical direction. That is to say, the third wire 1210 is disposed above or below the first wire 1110 in the vertical direction. The fourth wire 1220 is disposed in the second area 1500 and at least partially overlapped with the second wire 1120 in the vertical direction. That is to say, the fourth wire 1220 is disposed above or below the second wire 1120 in the vertical direction.

In one embodiment, one of the at least two first sub-wires 1112, 1114 is coupled to one of the at least two third sub-wires 1212, 1214. For example, the first sub-wire 1112 is coupled to the third sub-wire 1212 at a connection point A, and the first sub-wire 1114 is coupled to the third sub-wire 1214 at a connection point B. In addition, the first sub-wire 1112 and the third sub-wire 1212 may be coupled through a vertical connector (i.e., a via) at the connection point A in a top-view direction of the inductor device 1000. Additionally, the first sub-wire 1114 and the third sub-wire 1214 may be coupled through a vertical connector at the connection point B in the top-view direction of the inductor device 1000. However, the present disclosure is not limited to the above connection method. Those skilled in the art may design the connection method depending on practical needs.

In another embodiment, one of the at least two second sub-wires 1122, 1124 is coupled to one of the at least two fourth sub-wires 1222, 1224. For example, the second sub-wire 1122 is coupled to the fourth sub-wire 1222 at a connection point C, and the second sub-wire 1124 is coupled to the fourth sub-wire 1224 at a connection point D. In addition to that, the second sub-wire 1122 and the fourth sub-wire 1222 may be coupled through a vertical connector at the connection point C in the top-view direction of the inductor device 1000. In addition, the second sub-wire 1124 and the fourth sub-wire 1224 may be coupled through a vertical connector at the connection point D in the top-view direction of the inductor device 1000. However, the present disclosure is not limited to the above connection method. Those skilled in the art may design the connection method depending on practical needs.

In still another embodiment, one of the at least two first sub-wires 1112, 1114 is coupled to one of the at least two second sub-wires 1122, 1124. For example, the first sub-wire 1112 is coupled to a connector 1230 at a connection point E, and is coupled to the second sub-wire 1124 at a connection point F through the connector 1230. The first sub-wire 1114 is coupled to a connector 1240 at a connection point G. The connector 1240 is coupled to a connector 1250 through a connector 1130, and is coupled to the second sub-wire 1122 at a connection point H. However, the present disclosure is not limited to the above connection method. Those skilled in the art may design the connection method depending on practical needs.

A description is provided with reference to FIG. 2. In one embodiment, each of the at least two first sub-wires 1112, 1114 is wound into a plurality of turns. For example, the first sub-wire 1112 may be wound into a plurality of turns. In addition, the first sub-wire 1114 may be wound into a plurality of turns. However, the first sub-wires 1112, 1114 of the present disclosure are not limited to the numbers of turns shown in the figure. Those skilled in this art may design the numbers of turns depending on practical needs. In another embodiment, the at least two first sub-wires 1112, 1114 are not directly coupled to each other. That is to say, the at least two first sub-wires 1112 and 1114 are not coupled to each other without additional connector and/or wire.

A description is provided with reference to FIG. 2. In another embodiment, each of the at least two second sub-wires 1122, 1144 is wound into a plurality of turns. For example, the second sub-wire 1122 may be wound into a plurality of turns. Additionally, the second sub-wire 1124 may be wound into a plurality of turns. However, the second sub-wires 1122, 1124 of the present disclosure are not limited to the numbers of turns shown in the figure. Those skilled in this art may design the numbers of turns depending on practical needs. In still another embodiment, the at least two second sub-wires 1122, 1124 are not directly coupled to each other.

A description is provided with reference to FIG. 3. In one embodiment, each of the at least two third sub-wires 1212, 1214 is wound into a plurality of turns. For example, the third sub-wire 1212 may be wound into a plurality of turns. In addition to that, the third sub-wire 1214 may be wound into a plurality of turns. However, the third sub-wires 1212, 1214 of the present disclosure are not limited to the numbers of turns shown in the figure. Those skilled in this art may design the numbers of turns depending on practical needs. In another embodiment, the at least two third sub-wires 1212, 1214 are directly coupled to each other. For example, as shown in FIG. 3, the third sub-wires 1212, 1214 are directly coupled on an upper side of the figure.

A description is provided with reference to FIG. 3. In another embodiment, each of the at least two fourth sub-wires 1222, 1224 is wound into a plurality of turns. For example, the fourth sub-wire 1222 may be wound into a plurality of turns. In addition, the fourth sub-wire 1224 may be wound into a plurality of turns. However, the fourth sub-wires 1222, 1224 of the present disclosure are not limited to the numbers of turns shown in the figure. Those skilled in this art may design the numbers of turns depending on practical needs. In still another embodiment, the at least two fourth sub-wires 1222, 1224 are not directly coupled to each other.

A description is provided with reference to FIG. 1 to FIG. 3. One of the at least two third sub-wires 1212, 1214 is coupled with one of the at least two first sub-wires 1112, 1114 on a first side of the first area 1400 in an interlaced manner, and another one of the at least two third sub-wires 1212, 1214 is coupled with another one of the at least two first sub-wires 1112, 1114 on a second side of the first area 1400 in an interlaced manner. In one embodiment, the first side of the first area 1400 is opposite to the second side of the first area 1400. For example, the third sub-wire 1212 is coupled with the first sub-wire 1112 on a left side of the first area 1400 in an interfaced manner, and the third sub-wire 1214 is coupled with the first sub-wire 1114 on a right side of the first area 1400 in an interlaced manner.

In one embodiment, the third wire 1210 is disposed above the first wire 1110 or disposed below the first wire 1110. In other words, the third wire 1210 partially overlaps the first wire 1110 in the top-view direction of the inductor device 1000.

A description is provided with reference to FIG. 1 to FIG. 3. One of the at least two fourth sub-wires 1222, 1224 is coupled with one of the at least two second sub-wires 1122, 1124 on a first side of the second area 1500 in an interlaced manner, and another one of the at least two fourth sub-wires 1222, 1224 is coupled with another one of the at least two second sub-wires 1122, 1124 on a second side of the second area 1500 in an interlaced manner. In one embodiment, the first side of the second area 1500 is opposite to the second side of the second area 1500. For example, the fourth sub-wire 1222 is coupled with the second sub-wire 1122 on a left side of the second area 1500 in an interlaced manner, and the fourth sub-wire 1224 is coupled with the second sub-wire 1124 on a right side of the second area 1500 in an interlaced manner.

In one embodiment, the fourth wire 1220 is disposed above the second wire 1120 or disposed below the second wire 1120. In other words, the fourth wire 1220 partially overlaps the second wire 1120 in the top-view direction of the inductor device 1000.

In another embodiment, the first wire 1110 and the second wire 1120 are located on a same layer, and the third wire 1210 and the fourth wire 1220 are located on a same layer. Additionally, the first wire 1110 is located on a different layer from the third wire 1210, and the second wire 1120 is located on a different layer from the fourth wire 1220.

A description is provided with reference to FIG. 1 to FIG. 3. The inductor device 1000 further includes an input terminal 1600. The input terminal 1600 is disposed on one side (i.e., a lower side in the figure) of the second area 1500. In addition to that, the inductor device 1000 further includes a center-tapped terminal 1700. The center-tapped terminal 1700 is disposed on one side (i.e., an upper side in the figure) of the first area 1400. In one embodiment, if a vertical line located at a center of the inductor device 1000 is used as a reference, a left-sided structure and a right-sided structure of the inductor device 1000 are completely symmetrical in the top-view direction of the inductor device 1000. In addition, if a horizontal line located at the center of the inductor device 1000 is used as a reference, an upper-sided structure and a lower-sided structure of the inductor device 1000 are completely symmetrical except for the difference between the input terminal 1600 and the center-tapped terminal 1700.

Figure 4:
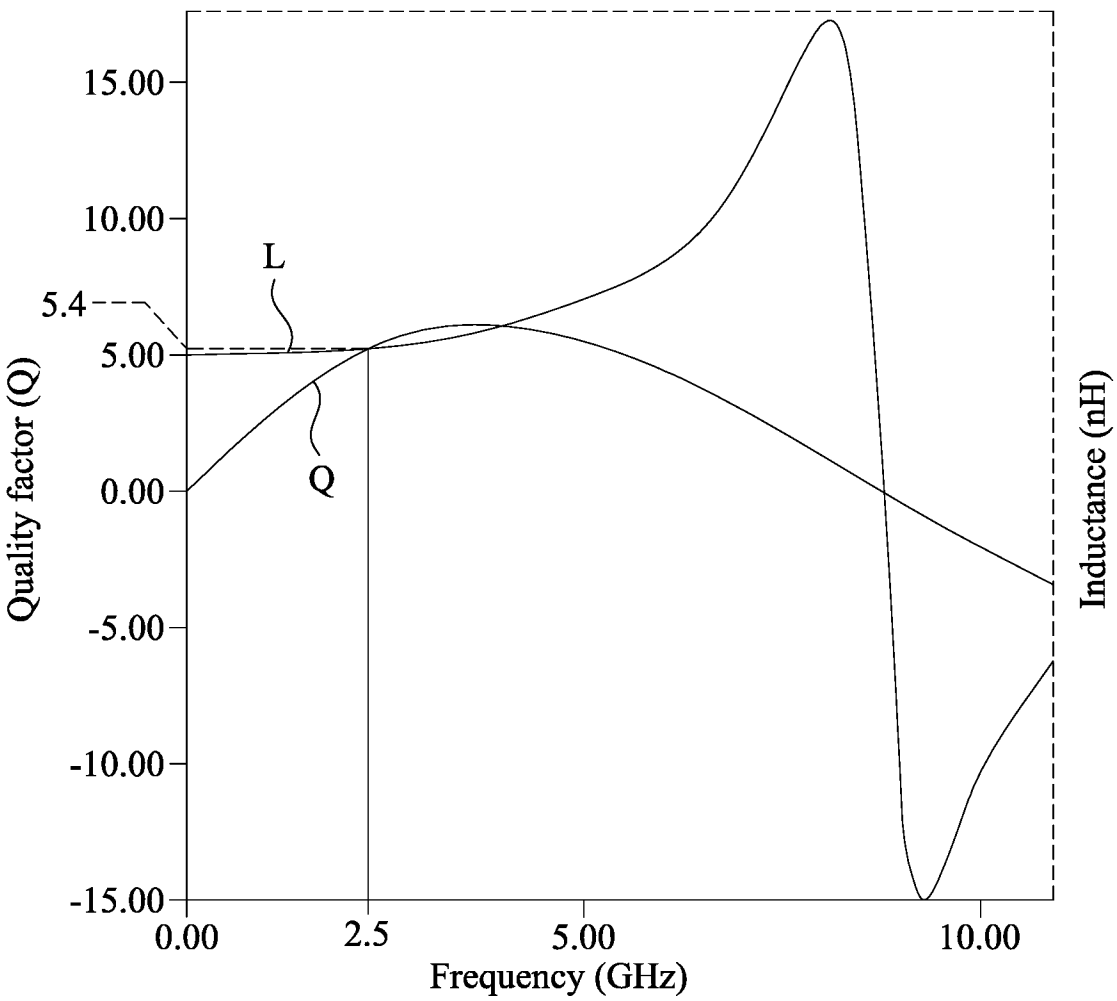
FIG. 4 depicts a schematic diagram of experimental data of an inductor device according to one embodiment of the present disclosure.

FIG. 4 depicts a schematic diagram of experimental data of the inductor device 1000 according to one embodiment of the present disclosure. As shown in the figure, with the structural configuration according to the present disclosure in the differential mode, the experimental curve of the quality factor is Q and the experimental curve of the inductance value is L. As shown in the figure, the inductor device 1000 adopting the structure of the present disclosure has a better inductance value per unit area. For example, the inductor device 1000 has an inductance value that can reach about 5.4 nH and a quality factor (Q) of about 5.4 at a frequency of 2.5 GHz within an area of 90 um*90 um.

It can be understood from the embodiments of the present disclosure that application of the present disclosure has the following advantages. The inductor device shown in the embodiment of the present disclosure has better symmetry in structure. As shown in FIG. 1, if the vertical line is used as a reference, the left-sided structure and the right-sided structure of the inductor device 1000 are completely symmetrical in the top-view direction of the inductor device 1000. Additionally, if the horizontal line is used as a reference, the upper-sided structure and the lower-sided structure of the inductor device 1000 are nearly completely symmetrical.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inductor device, comprising:

a first wire disposed in a first area, wherein the first wire comprises at least two first sub-wires;

a second wire disposed in a second area, wherein the second wire comprises at least two second sub-wires;

a third wire disposed in the first area and being at least partially overlapped with the first wire in a vertical direction, wherein the third wire comprises at least two third sub-wires;

a fourth wire disposed in the second area and being at least partially overlapped with the second wire in the vertical direction, wherein the fourth wire comprises at least two fourth sub-wires; and an eight-shaped inductor structure disposed on an outer side of the third wire and the fourth wire.

2. The inductor device of claim 1, wherein one of the at least two first sub-wires is coupled to one of the at least two third sub-wires.

3. The inductor device of claim 1, wherein one of the at least two second sub-wires is coupled to one of the at least two fourth sub-wires.

4. The inductor device of claim 1, wherein one of the at least two first sub-wires is coupled to one of the at least two second sub-wires.

5. The inductor device of claim 1, wherein each of the at least two first sub-wires is wound into a plurality of turns.

6. The inductor device of claim 5, wherein the at least two first sub-wires are not directly coupled to each other.

7. The inductor device of claim 6, wherein each of the at least two second sub-wires is wound into a plurality of turns.

8. The inductor device of claim 7, wherein the at least two second sub-wires are not directly coupled to each other.

9. The inductor device of claim 1, wherein each of the at least two third sub-wires is wound into a plurality of turns.

10. The inductor device of claim 9, wherein the at least two third sub-wires are directly coupled to each other.

11. The inductor device of claim 10, wherein each of the at least two fourth sub-wires is wound into a plurality of turns.

12. The inductor device of claim 11, wherein the at least two fourth sub-wires are not directly coupled to each other.

13. The inductor device of claim 1, wherein one of the at least two third sub-wires is coupled with one of the at least two first sub-wires on a first side of the first area in an interlaced manner, and another one of the at least two third sub-wires is coupled with another one of the at least two first sub-wires on a second side of the first area in an interlaced manner.

14. The inductor device of claim 13, wherein the first side of the first area is opposite to the second side of the first area.

15. The inductor device of claim 1, wherein the third wire is disposed above the first wire or below the first wire.

16. The inductor device of claim 1, wherein one of the at least two fourth sub-wires is coupled with one of the at least two second sub-wires on a first side of the second area in an interlaced manner, and another one of the at least two fourth sub-wires is coupled with another one of the at least two second sub-wires on a second side of the second area in an interlaced manner.

17. The inductor device of claim 16, wherein the first side of the second area is opposite to the second side of the second area.

18. The inductor device of claim 1, wherein the fourth wire is disposed above the second wire or below the second wire.

19. The inductor device of claim 1, wherein the first wire and the second wire are located on a same layer, the third wire and the fourth wire are located on a same layer.

20. The inductor device of claim 19, wherein the first wire is located on a different layer from the third wire, and the second wire is located on a different layer from the fourth wire.

* * * * *